US006682064B2

(12) United States Patent
Leu et al.

(10) Patent No.: US 6,682,064 B2
(45) Date of Patent: Jan. 27, 2004

(54) METHOD AND APPARATUS FOR DISMANTLING A STACK OF FLAT OBJECTS PIECE BY PIECE

(75) Inventors: Willy Leu, Pfäffikon (CH); Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/076,200

(22) Filed: Feb. 14, 2002

(65) Prior Publication Data

US 2002/0109284 A1 Aug. 15, 2002

(30) Foreign Application Priority Data

Feb. 15, 2001 (CH) ..... 0266/01

(51) Int. Cl.[7] ..... B65H 3/30

(52) U.S. Cl. ..... 271/21; 271/19; 271/113; 271/115; 271/42; 271/170; 271/167; 414/796.8; 414/796.6

(58) Field of Search ..... 271/19, 21, 113, 271/115, 42, 170, 167; 221/259, 268; 414/796.8, 796.6

(56) References Cited

U.S. PATENT DOCUMENTS

| | | | | | |
|---|---|---|---|---|---|
| 1,016,779 | A | * | 2/1912 | Ruppel | 221/259 |
| 2,795,419 | A | * | 6/1957 | Ritzerfeld et al. | 271/19 |
| 3,008,709 | A | * | 11/1961 | Buslik | 271/37 |
| 3,090,505 | A | * | 5/1963 | Mead et al. | 414/796 |
| 3,285,601 | A | * | 11/1966 | Zeuthen | 271/17 |
| 3,583,697 | A | | 6/1971 | Tippy | |
| 3,645,527 | A | * | 2/1972 | Gates | 271/42 |
| 3,713,645 | A | * | 1/1973 | Ferrari et al. | 271/121 |
| 4,136,861 | A | * | 1/1979 | Goff, Jr. | 271/22 |
| 4,444,385 | A | * | 4/1984 | Berry | 271/22 |
| 5,984,295 | A | * | 11/1999 | Britz | 271/22 |
| 6,068,157 | A | | 5/2000 | Kamiya | |

FOREIGN PATENT DOCUMENTS

| | | | | |
|---|---|---|---|---|
| CH | 436 349 A | | 5/1967 | |
| CH | 682020 A5 | * | 6/1993 | G07F/11/04 |
| DE | 12 37 587 B | | 3/1967 | |
| DE | 41 36 194 A1 | | 5/1993 | |
| DE | 196 42 485 A1 | | 4/1998 | |
| JP | 52-31464 | * | 3/1977 | B65H/3/06 |
| JP | 06135576 A | * | 5/1994 | B65H/1/26 |

* cited by examiner

*Primary Examiner*—Donald P. Walsh
*Assistant Examiner*—Matthew J. Kohne
(74) *Attorney, Agent, or Firm*—Alston & Bird LLP

(57) ABSTRACT

A method for dismantling a stack (1) of flat objects (2, 3) piece by piece, in which the top object (2) of the stack (1) is moved in its plane, gripped at its freed edge and removed from the stack (1). The top object (2) is moved against a stop (5), at least in the region of one of its corners (2*b*), by a movable separating element (6, 6') and, as a result of further movement, is bent in such a way that it escapes from the stop (5) and is moved out of the stack (1). The invention further relates to an apparatus for dismantling a stack (1) of flat objects (2, 3) piece by piece.

17 Claims, 4 Drawing Sheets

Fig.4
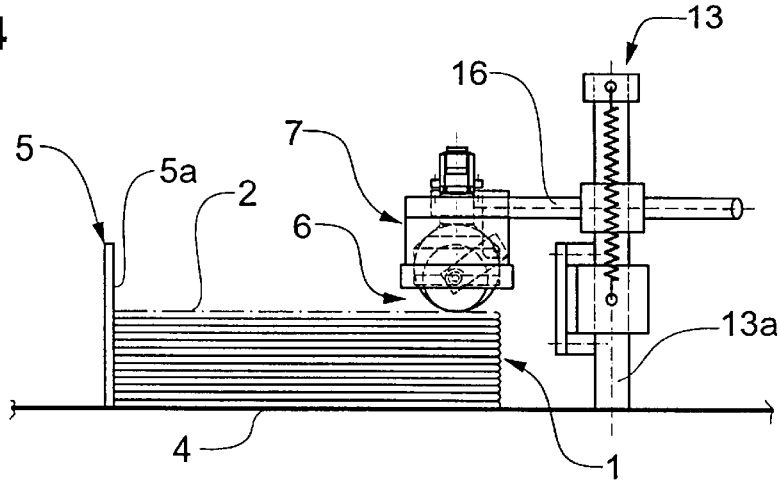
Fig.5
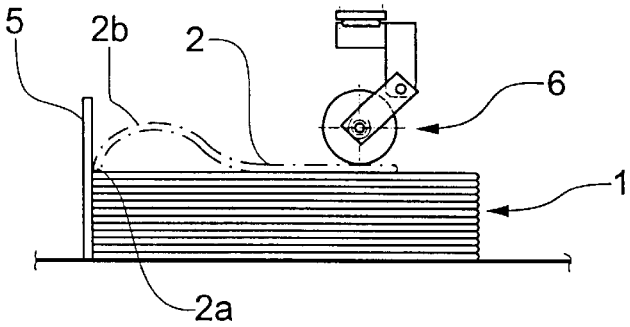
Fig.6A
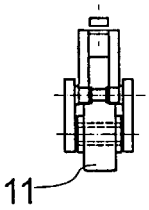
Fig.6B
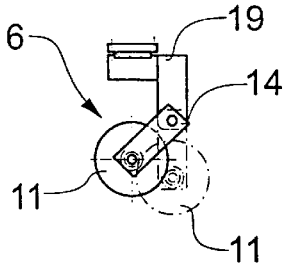
Fig.7A
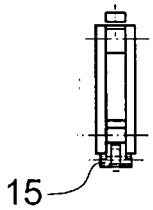
Fig.7B
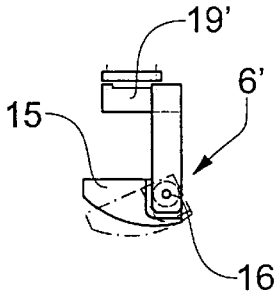
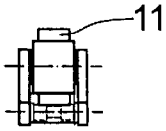
Fig.6C
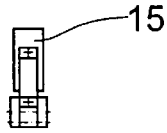
Fig.7C

METHOD AND APPARATUS FOR DISMANTLING A STACK OF FLAT OBJECTS PIECE BY PIECE

BACKGROUND OF THE INVENTION

The invention relates to a method and an apparatus for dismantling a stack of flat objects piece by piece.

A method and an apparatus of the described type are disclosed by CH 436349. In the method described there, a stack of flat objects is dismantled piece by piece by the top object on the stack being rotated out of the stack in its plane, gripped at its freed edge and removed from the stack. The top object is moved with a drive element or separating element which, on the top object, can be switched toward and away from the latter. In order to grip and remove the object rotated out, conveying means are used. The known method has the advantage that the movement of the top object in its plane can be implemented very simply. However, the friction between two objects resting on one another is a problem in this case, and leads to the second object from the top being carried along during the movement of the top object. As a result, gripping the top object rotated out is made more difficult, and the alignment of the stack is disrupted.

A further apparatus for separating and conveying sheets is disclosed by DE-A 4136194. In this case, the top sheet is accelerated obliquely with respect to the sheet leading edge and gripped at a freed edge. Here, too, there is the problem that sheets lying further down are carried along by friction during the movement of the top sheet.

A further apparatus, in which individual sheets of a sheet stack are separated by being rotated by means of a turntable, is disclosed by DE-A 19642485. In order to prevent the lower sheets from slipping during the rotation of the top sheet, corner separators are fitted at at least three corners of the sheet stack. These have the task of holding on the stack at least the sheets lying in the upper region of the sheet stack. In order to further prevent slipping, it is proposed to place a clamping finger on the free surface, which is produced during the rotation of the top sheet, of the sheet lying in the second from top position. The clamping finger is able to act on this free surface and hold the sheet stack. Both solution proposals have the disadvantage that the position of the corner separators or the clamping finger have to be matched to the instantaneous stack height. The height of the corner separators has to be chosen such that the three corners of the top sheet can move over the corner separators, but the sheets lying underneath are not rotated at the same time. The clamping finger has to be controlled synchronously with the rotation of the top sheet in such a way that it always firmly holds the second sheet from the top and releases it at the correct time. The cycle rate of the apparatus is limited, since the top sheet must first be conveyed out of the stack to a great extent before the turntable can make access to the second sheet from the top.

The invention is therefore based on the object of specifying a method and an apparatus in which the individual objects can be removed from a stack in a straightforward way at a high cycle rate, without impairing the stack formation. The removal of the top object is to proceed independently of the stack height.

SUMMARY OF THE INVENTION

The above and other objects and advantages of the present invention are achieved by the provision of a method and apparatus which are particularly suitable for separating very flat, flexible objects such as paper or plastic sheets. According to the invention, the top sheet is moved in its plane against a stop, at least in the region of one of its corners by a movable separating element. Because it strikes the stop, and in the process continues to be moved, it is bent in such a way that it escapes from the stop, preferably sideways, and is moved out of the stack. All the objects lying under the top object are stopped by the stop and remain aligned if they were moved together with the top object in a frictional connection.

The top object is preferably moved with a movement component perpendicular to the stop and a movement component transversely thereto, so that it strikes the stop, is compressed against the latter and finally jumps away from the latter transversely and can preferably be moved onward in its plane, for example also by suitable output conveying means. The stop preferably acts only on one corner of the object. Such a stop can easily be overcome by the top object, while it reliably holds all the other objects of the stack in position. The stop preferably extends from the supporting surface of the stack up to a height which is slightly greater than the typical stack height. The height of the stop does not have to be matched to the stack height, in particular if the top object, as already described, is pushed past the stop sideways.

The top sheet can be moved linearly, in the case of a rectangular object preferably obliquely with respect to its edges and to the alignment of the stop. However, a rotational movement of the top object can be implemented particularly simply about an axis of rotation running perpendicular to the plane of the object. The top object is set moving by a separating element which preferably acts on the top object with a forcible or frictional connection. A separating element with a suction action can also be used. Furthermore, the trailing edge of the object can be lifted by a sucker and a slider, which slides the object out of the stack, and can engage under it.

Because the separating element is movable, an increase in the cycle rate is possible. The top sheet is moved by the movement of the separating element in a forcible or frictional connection until it jumps off the stop and is offset with respect to the stack surface. The separating element is then moved back into its initial position, where it makes immediate access to a region of the second sheet from the top which is now exposed and can move said sheet during the renewed forward movement. During this time, the top sheet is drawn out of the stack by suitable output conveying means. "Gripping" is understood to mean any type of transfer to the output conveying means, for example, also by being deposited on a conveyor belt. By means of the invention, an overlapping formation of the separated sheets can be produced particularly simply. The separating element preferably describes part of a circular path. The stroke or the distance covered needs to be only sufficiently long for the edge of the top sheet moved against the stop to jump off the stop. Depending on the configuration of the stop, therefore, a movement path of fractions of the sheet length is sufficient. The cycle frequency of the apparatus can be increased accordingly.

BRIEF DESCRIPTION OF THE DRAWINGS

Embodiments of the invention are represented in the drawing and described below. In the drawing, purely schematically:

FIG. 4 shows an apparatus according to the invention in side view with a paper stack aligned on a stop;

FIG. 5 shows an apparatus according to the invention in side view with a top object bent against a stop;

FIGS. 6A–6C show various views of a separating element having a roller;

FIGS. 7A–7C show various views of a separating element having a shoe;

DETAILED DESCRIPTION OF THE PREFERRED EMBODIMENTS

Figure 1A:
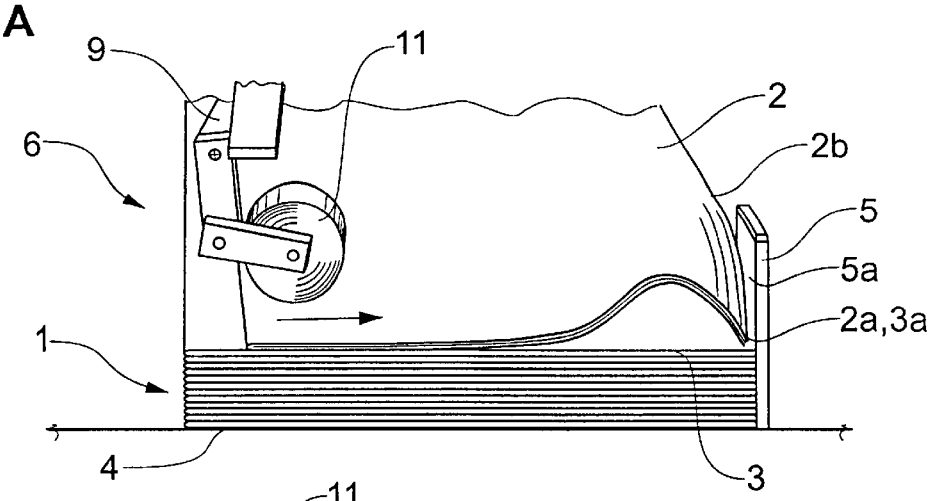
FIGS. 1A–1C show the sequence of the separating method according to the invention.
Figure 1B:
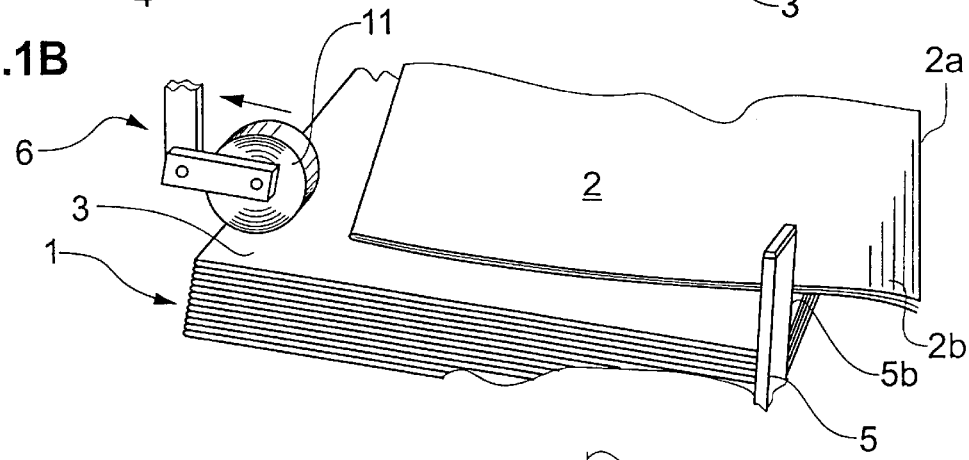
Figure 1C:
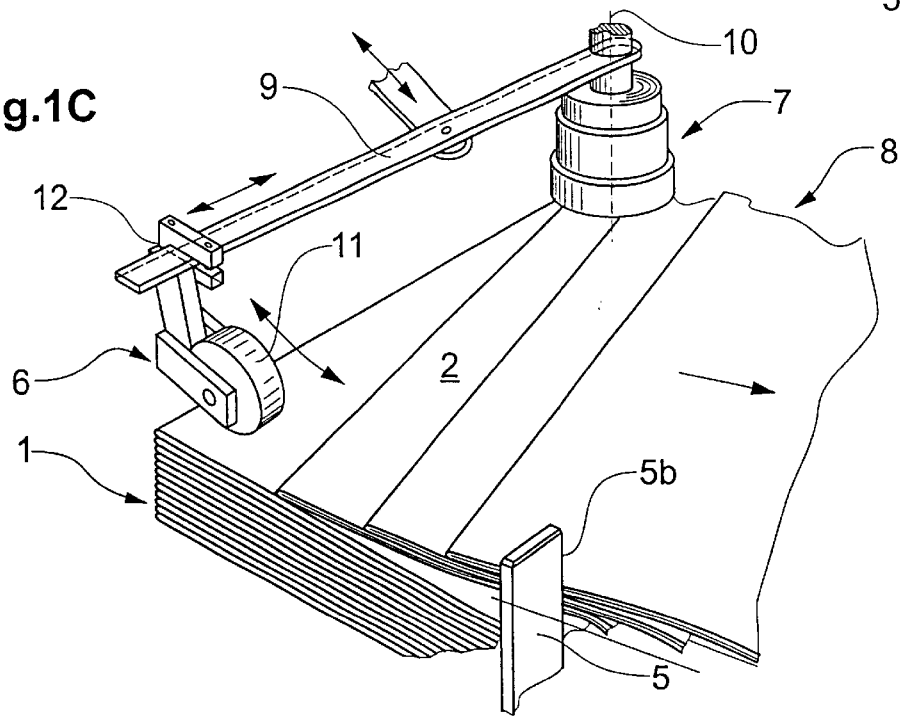

FIGS. 1A–C show the performance of the separating method according to the invention. A stack 1 of rectangular, flat objects 2, 3 is located on a supporting surface 4, which is limited at the side by a stop 5. The stop 5 is designed as a flat, vertically aligned plate. The front edge 2*a*, 3*a* of the objects touches the front face 5*a* of the stop 5 which faces the stack 1. The stop 5 extends sideways only over a fraction of the front edge 2*a*, 3*a* of the flat objects.

Figure 2:
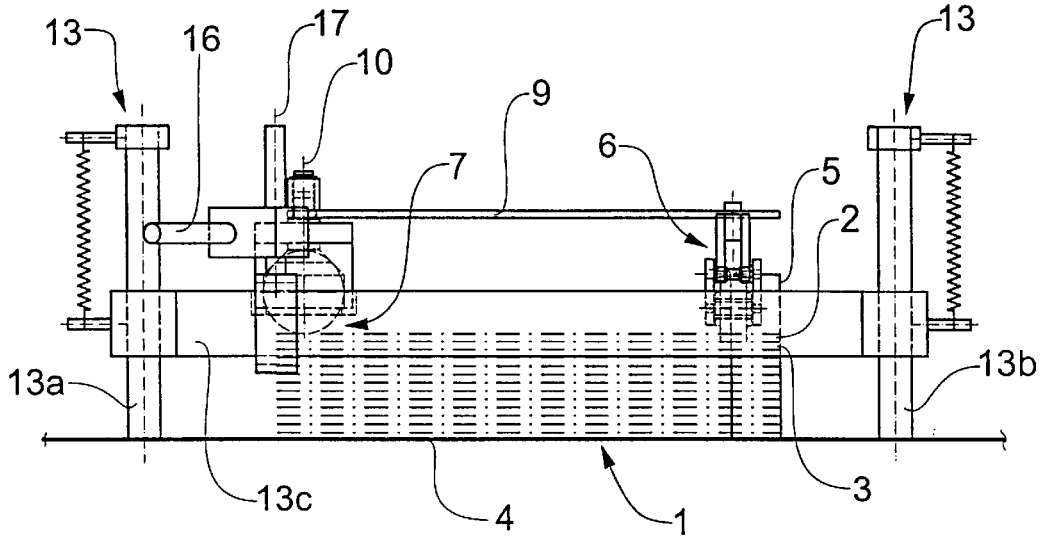
FIG. 2 shows an apparatus according to the invention in side view.
Figure 3:
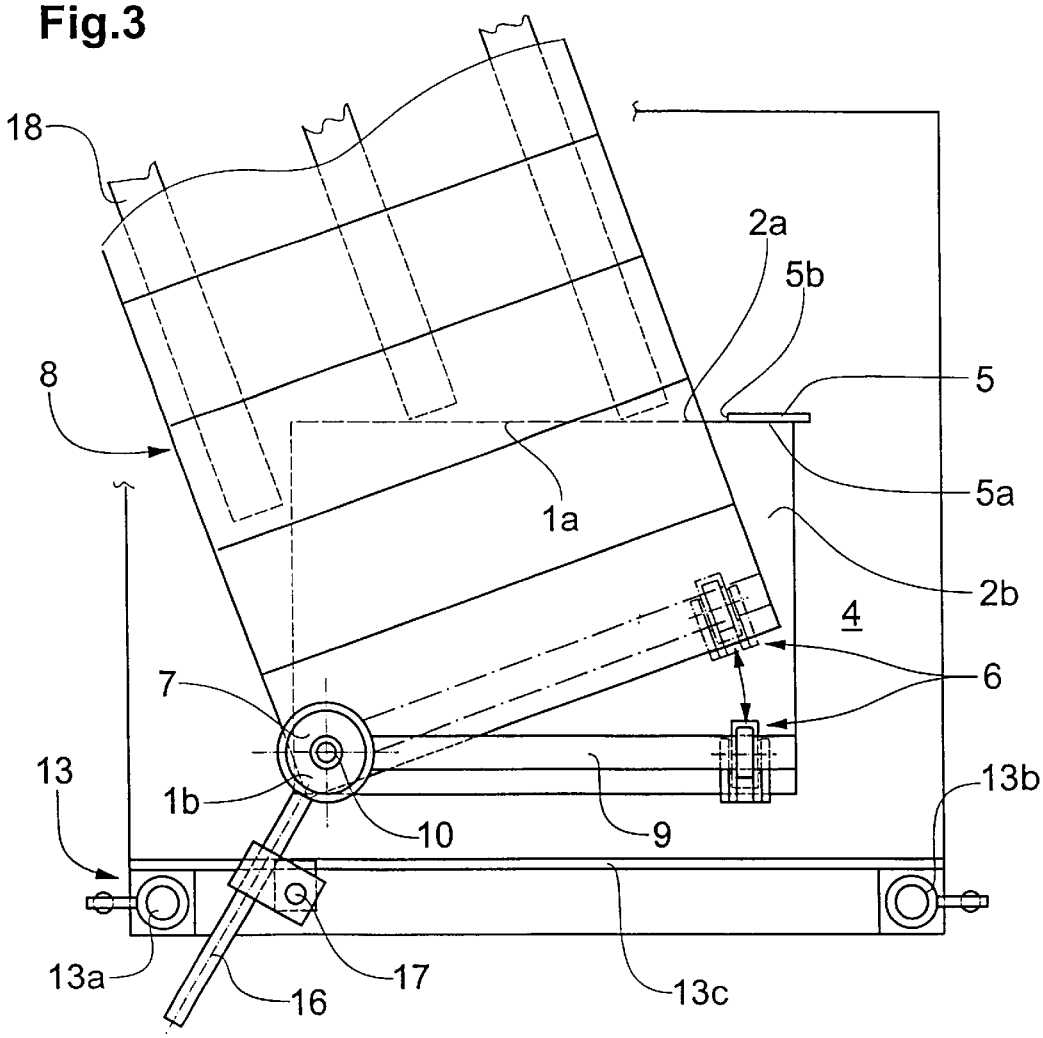
FIG. 3 shows an apparatus according to the invention in a view from above.

At the corner of the supporting surface 4 that is diagonally opposite the stop 5, there is a pressure element 7. By the latter, pressure is exerted on the stack 1 from above, as a result of which the objects 2, 3 are fixed and therefore held together in a direction running perpendicular to their plane. The pressure element 7 is placed on the stack 1 in a floating manner by a holding device 13, which is illustrated in FIGS. 2–4. Via a lever 9, a separating element 6 is pivotably connected to the pressure element 7, so that the separating element 6 can automatically be adjusted vertically in such a way that it is always capable of moving the top object 2 of the stack 1. The separating element 6 is pivoted about an axis of rotation 10 running through the pressure element 7 perpendicular to the plane of the flat objects 2, 3. The separating element 6 carries the top object 2 with it in a forcible frictional connection as it moves in the direction of the stop 5. The situation during this forward movement is shown in FIG. 1A. As a result, the top object 2 is moved against the stop 5 and compressed there. During the further forward movement, the front edge 2*b* of the top object slides past the side edge 5*b* of the stop. This situation is shown in FIG. 1B. The separating element 6 is then moved back into its initial position by pivoting back around the axis 10.

The top object 2 pushed out of the stack can then be gripped at its projecting corners, for example in the region of the front edge 2*a*, for example deposited on a conveyor belt and transported away. As the separating element 6 is drawn back into its initial position, the forcible connection with the top object 2 and the object 3 lying underneath and now exposed is released. For this purpose, the separating element 6 in the present example comprises a roller 11 with a very grippy surface, which does not rotate during the forward movement toward the stop and, during the reverse movement away from the stop, rolls on the object now lying at the top. Alternative separating elements are illustrated in FIGS. 6A–6C and 7A–7C. The distance of the separating element 6 from the axis of rotation 10 or the pressure element 7 can be varied via a slide 12. The slide 12 can be displaced on the lever 9.

Using the technique described, individual objects 2 can be removed from the stack. By means of periodic movement of the separating element 6, it is further possible for an overlapping formation 8 of objects 2 arranged offset with respect to one another to be produced, which is shown in FIG. 1C.

FIGS. 2 to 4 show various views of a separating apparatus according to the invention. A stack 1 of flat objects 2, 3 is located on a flat supporting surface 4.

Figure 8:
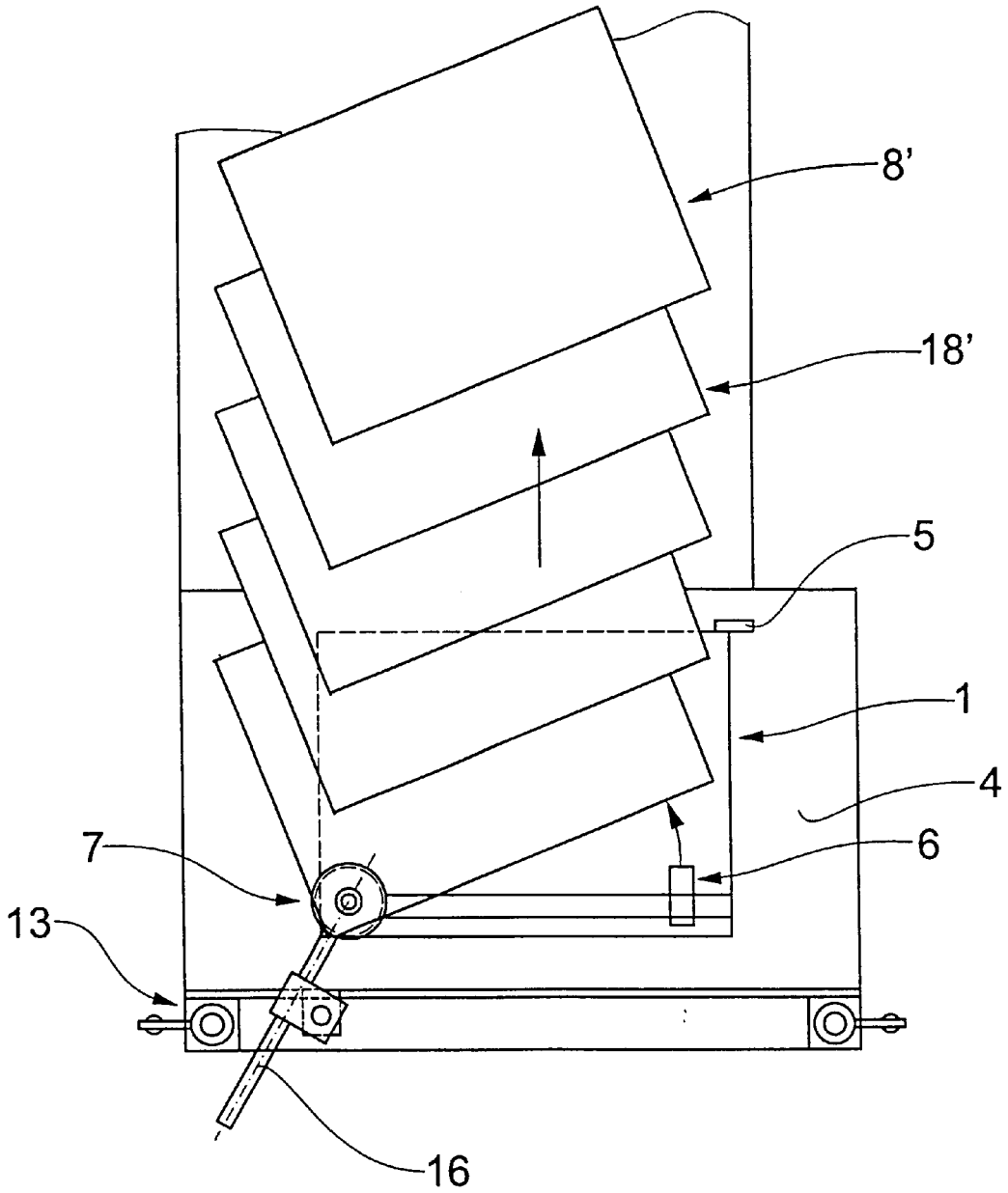
FIG. 8 shows an apparatus according to the invention having a conveying device for producing a diagonally overlapping formation.

In the region of its front edge 1A, the stack 1 is bounded by a vertically aligned flat stop 5. At its corner 1*b* lying obliquely opposite the stop 5, the stack 1 is weighed on by a pressure element 7. The pressure element 7, here in the form of a pressure sphere, is held in a floating manner on a holding device 13. The holding device 13 comprises two columns 13*a*, 13*b* arranged at the side of the stack 1, on which a plate 13*c* is suspended in a sprung manner. The plate 13*c* can move in the vertical direction. The pressure element 7 is connected to the plate 13*c* via a holding element 16 and can be displaced along the plate 13*c* in order to match the apparatus to different dimensions of the stack 1. Furthermore, the pressure element can also be pivoted about an axis 17 running parallel to the columns 13*a*, 13*b*. In operation, the pressure element 7 is rigidly connected to the plate 13*c*. The height of the stack 1 can therefore be determined via the height of the plate 13*c*. A separating element 6 is connected to the pressure element 7 via a lever 9. Said element can be pivoted about an axis of rotation 10 running through the pressure element 7 and perpendicular to the supporting surface 4. The design illustrated ensures that the pressure element always rests on the stack 1. By means of a suitable drive, the separating element 6 is rotated about the axis of rotation 10 in the direction of the stop 5 in order to force the top object 2 initially with its front edge 2*a* against the stop 5 and finally past the latter sideways. The separated products are aligned obliquely with respect to the stack 1 and are transported away in an overlapping formation 8 by a conveying device 18. The conveying device 18 can be a belt conveyor or a gripper transporter. As an alternative to the overlapping formation 8, objects 2 can also be drawn off the stack and further processed individually. With a conveying device 18' oriented parallel to the alignment of the stack 1, a diagonally overlapping formation 8' can be produced, in which individual objects overlap one another so as to be offset in relation to one another in two directions. The production of such a diagonally overlapping formation is represented in FIG. 8.

FIG. 5 shows, schematically, an instantaneous image of the stack 1, whose top object 2 is being moved against the stop 5 by the separating element 6. The front edge 2*a* of the top object 2 strikes the stop 5, so that the top object 2 bows up in the region of its corner 2*b* facing the stop. During the further movement of the top object 2 with a movement component transverse with respect to the alignment of the stop 5, the top object is ultimately bent to such an extent that it slides past the stop 5 sideways, see also FIG. 1*b*. The separating element can then be moved back again into the initial position, which is shown in FIG. 4.

FIGS. 6A–6C and 7A–7C show two different separating elements, in respectively two side views and in the view from above. The separating element 6 according to FIGS. 6A to 6C comprises a roller 11, which is mounted on a holding element 19 such that it can be pivoted about a pivot axis 14 running parallel to the roller axis. The roller 11 has a sticky cover. The separating element 6 has a backstop, so that the roller 11 blocks as it moves from the initial position in the direction of the stop 5, and in this way displaces the top object toward the stop in the forcible or frictional connection. During the movement back into the initial position, the roller rolls with little friction on the object which is now at the top. The separating element 6' according to FIGS. 7A–7C comprises a thumb stop 15, which is arranged on a holding element 19' such that it can pivot about an axis 16. The thumb stop 15 has a sticky cover which, during the forward movement of the separating element 6', moves the top object 2 with it in a frictional connection. As the separating element 6' is drawn back, the thumb stop 15 is pivoted in such a way that a non-sticky region or an incorporated roller slides or rolls with as little friction as possible over the object which is now at the top.

We claim:

1. A method for producing an overlapping formation of flat objects arranged offset with respect to one another by dismantling a stack of flat objects piece by piece, comprising the steps of:

bringing a movable separating element into a forcible or frictional engagement with the top object of the stack in a region closely adjacent one of the edges of the top object;

pivoting the separating element from an initial position about a pivotal axis of rotation running substantially perpendicular to the plane of the top object so as to rotate the top object of the stack in its plane against a stop which is located at least in the region of one of the corners of the stack opposite the one edge where the separating element acts;

bending, as a result of the rotational movement and its engagement with the stop, the top object in such a way that it escapes from the stop but still overlaps with the object underlying the top object;

moving the separating element back to the initial position and bringing it into engagement with the object underlying the top object;

rotating the object underlying the top object by again pivoting the separating element about said pivotal axis of rotation, while maintaining an overlapping formation of the top object and the object underlying the top object; and gripping the top object at a freed edge which is opposite said one edge and removing it from the stack.

2. The method as claimed in claim 1, wherein the forcible or frictional connection is released while or before the freed edge is gripped, and the separating element is then moved back into the initial position.

3. The method as claimed in claim 2, wherein there is exerted on the stack a pressure directed substantially perpendicular to its plane while the top object is moved in its plane.

4. The method as claimed in claim 1, wherein the top object of the stack is rotated by the separating element against the stop about a rotational axis of rotation which corresponds to the pivotal axis of rotation of the separating element and is moved out of the stack.

5. The method as claimed in claim 4, wherein the rotational axis of rotation of the top object lies within its outline.

6. The method as claimed in claim 5, wherein pressure is exerted on the stack at a point which is aligned with the rotational axis of rotation during the rotational movement.

7. The method as claimed in claim 4, wherein the stop is located in the region of only that corner of the top object or the stack which is at the greatest distance from the pivotal axis of rotation of the separating element.

8. The method as claimed in claim 1, wherein the top object is rotated by the separating element so that upon the top object engaging the stop the top object escapes transversely from the stop.

9. The method as claimed in claim 1 comprising the further steps of maintaining the objects which have been removed from the stack in an overlapping formation and transporting the overlapping formation away from the stack.

10. An apparatus for producing an overlapping formation of flat objects by dismantling a stack of flat objects piece by piece, comprising a supporting surface for the stack, a separating element which is mounted for movement in a plane running parallel to the supporting surface and for pivotal movement about an axis of rotation running substantially perpendicular to the supporting surface so as to be capable of moving at least the top object in its plane in a forcible or frictional connection, thereby rotating the top object about the axis of rotation, and further comprising a stop which is located at the side of the stack and against which the top object is moved by the separating element such that the top object, as a result of such movement is bent in such a way that it escapes from the stop and is moved out of the stack, and wherein the separating element is configured to act in a region closely adjacent the edge of the top object which is opposite the stop.

11. The apparatus as claimed in claim 10, wherein the separating element is vertically adjustable, its height being matched to the instantaneous stack height in such a way that it is always capable of moving the top object.

12. The apparatus as claimed in claim 10, wherein the separating element comprises a roller with a backstop, or a thumb stop, or a sucker.

13. The apparatus as claimed in claim 10 further comprising a pressure element configured for exerting pressure on the stack substantially perpendicular to its plane, and so that the axis of rotation runs through the pressure element.

14. The apparatus as claimed in claim 13, wherein the pressure element is configured to rest on the top object, so that the height of the stack can be determined by means of the pressure element.

15. The apparatus as claimed in claim 14, wherein the pressure element is connected to the separating element via a lever, so that the separating element is always located at the height of the top object of the stack and is capable of moving the latter.

16. The apparatus as claimed in claim 10, wherein the stop is arranged only in the region of that corner of the stack which is at the greatest distance from the axis of rotation.

17. The apparatus as claimed in claim 10, wherein the stop is aligned perpendicular to a plane defined by the objects and extends from the supporting surface up to a height which is greater than the height of the stack.

* * * * *